US010942474B2

(12) United States Patent
Morita

(10) Patent No.: US 10,942,474 B2
(45) Date of Patent: Mar. 9, 2021

(54) IMAGE FORMING APPARATUS HAVING A CLEANING BLADE SUPPORTED BY A SUPPORTING MEMBER

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/906,341

(22) Filed: Jun. 19, 2020

(65) Prior Publication Data

US 2020/0401066 A1 Dec. 24, 2020

(30) Foreign Application Priority Data

Jun. 24, 2019 (JP) ..... JP2019-116295

(51) Int. Cl.
*G03G 15/16* (2006.01)
*G03G 21/00* (2006.01)
*G03G 21/10* (2006.01)

(52) U.S. Cl.
CPC ..... *G03G 15/161* (2013.01); *G03G 21/10* (2013.01); *G03G 2215/1661* (2013.01)

(58) Field of Classification Search
CPC ..... G03G 15/161; G03G 21/10; G03G 2215/1647; G03G 2215/1661
See application file for complete search history.

(56) References Cited

U.S. PATENT DOCUMENTS

2003/0091373 A1* 5/2003 Abe ..... G03G 15/161 399/302
2005/0078991 A1* 4/2005 Kimura ..... G03G 15/161 399/350
2015/0277298 A1* 10/2015 Suzuki ..... G03G 15/161 399/101
2016/0154369 A1* 6/2016 Takase ..... G03G 15/161 399/101
2016/0195835 A1* 7/2016 Toso ..... G03G 15/161 399/101

(Continued)

FOREIGN PATENT DOCUMENTS

JP 6-161291 A 6/1994

*Primary Examiner* — Sophia S Chen
(74) *Attorney, Agent, or Firm* — Stein IP, LLC

(57) ABSTRACT

An image forming apparatus includes a plurality of image carriers, an intermediate transfer belt, a cleaning blade, a counter-roller, and a supporting member. The intermediate transfer belt is endless and, to it, toner images formed on the outer circumferential faces of the plurality of image carriers are transferred by being sequentially superposed on each other. The cleaning blade is arranged with its tip end portion in contact with the outer circumferential face of the intermediate transfer belt and removes deposits left on the outer circumferential face of the intermediate transfer belt. The counter-roller is arranged at a position opposite the cleaning blade across the intermediate transfer belt and is in contact with the inner circumferential face of the intermediate transfer belt. The supporting member supports the cleaning blade. The supporting member supports the cleaning blade rotatably about the rotation axis of the counter-roller.

5 Claims, 7 Drawing Sheets

(56) References Cited

U.S. PATENT DOCUMENTS

| | | | | |
|---|---|---|---|---|
| 2016/0252850 | A1* | 9/2016 | Fujiwara | G03G 15/161 399/264 |
| 2017/0023907 | A1* | 1/2017 | Shibuya | G03G 15/161 |
| 2017/0248873 | A1* | 8/2017 | Maeyama | G03G 15/161 |
| 2018/0341200 | A1* | 11/2018 | Ohsugi | G03G 15/161 |

* cited by examiner

IMAGE FORMING APPARATUS HAVING A CLEANING BLADE SUPPORTED BY A SUPPORTING MEMBER

INCORPORATION BY REFERENCE

This application is based upon and claims the benefit of priority from the corresponding Japanese Patent Application No. 2019-116295 filed on Jun. 24, 2019, the contents of which are hereby incorporated by reference.

BACKGROUND

The present disclosure relates to an image forming apparatus.

In image forming apparatuses of an electrophotographic type such as copiers and printers, there are known image forming apparatuses in an intermediate transfer system in which toner images in different colors formed on the outer circumferential faces of a plurality of photosensitive drums respectively are primarily transferred to an endless intermediate transfer belt arranged along the plurality of photosensitive drums (image carriers) by being sequentially superposed on each other, and then the toner image is secondarily transferred to a sheet.

For example, the conventional image forming apparatus includes a photosensitive member in a drum shape, a transfer belt, and a cleaning device. The cleaning device includes a cleaning blade which is kept in pressed contact with the outer circumferential face of the transfer belt to remove soil (such as untransferred toner) on the outer circumferential face. Furthermore, the cleaning device has a blade control mechanism which allows adjustment of the pressing force of the cleaning blade against the outer circumferential face of the transfer belt. This makes it possible to always keep constant the pressing force of the cleaning blade against the outer circumferential face of the transfer belt, and thus it is possible to ensure satisfactory cleaning performance.

SUMMARY

According to one aspect of what is disclosed herein, an image forming apparatus includes a plurality of image carriers, an intermediate transfer belt, a cleaning blade, a counter-roller, and a supporting member. The intermediate transfer belt is endless and, to it, toner images formed on the outer circumferential faces of the plurality of image carriers are transferred by being sequentially superposed on each other. The cleaning blade is arranged with its tip end portion in contact with the outer circumferential face of the intermediate transfer belt and removes deposits left on the outer circumferential face of the intermediate transfer belt. The counter-roller is arranged at a position opposite the cleaning blade across the intermediate transfer belt and is in contact with the inner circumferential face of the intermediate transfer belt. The supporting member supports the cleaning blade. The supporting member supports the cleaning blade rotatably about the rotation axis of the counter-roller.

DETAILED DESCRIPTION

An embodiment of the present disclosure will be described below with reference to the accompanying drawings. The present disclosure is, however, not limited to what is specifically described below.

Figure 1:
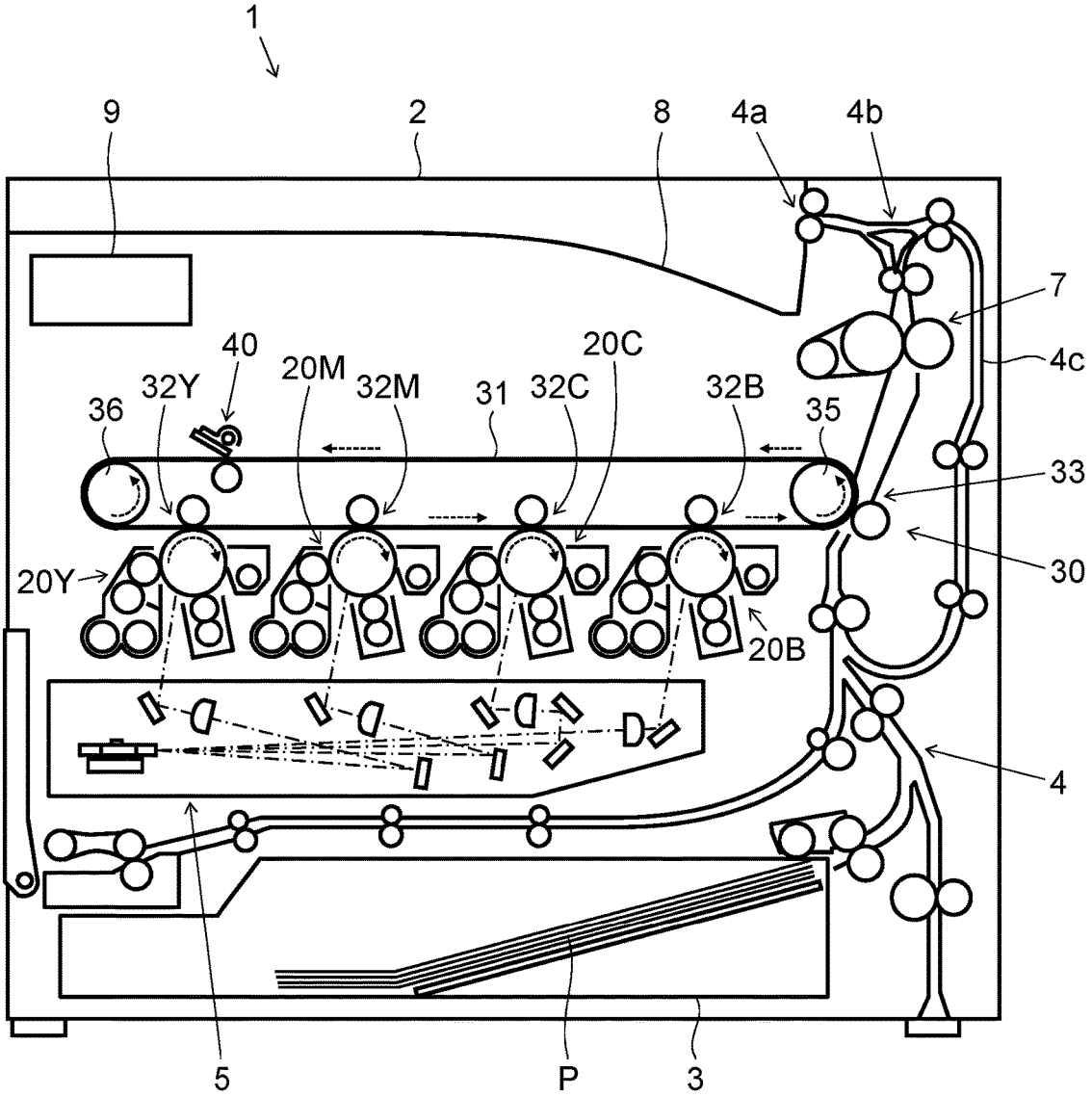
FIG. 1 is a schematic sectional view showing a structure of an image forming apparatus according to an embodiment of the present disclosure.
Figure 2:
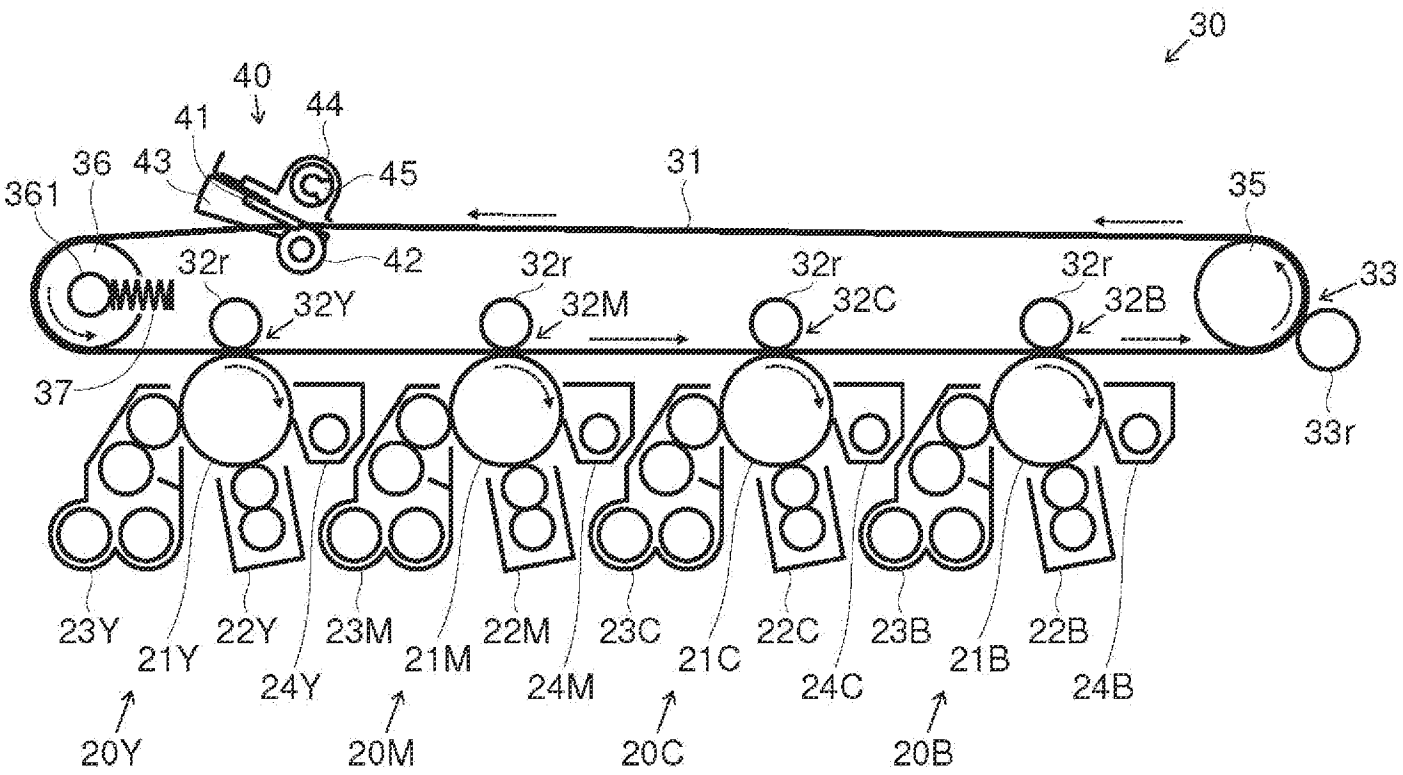
FIG. 2 is a partial sectional view of and around an image forming portion and an intermediate transfer belt in the image forming apparatus according to the embodiment of the present disclosure.

FIG. 1 is a schematic sectional view showing the structure of an image forming apparatus 1 according to the embodiment. FIG. 2 is a partial sectional view of and around an image forming portion 20 and an intermediate transfer belt 31 in the image forming apparatus 1. One example of the image forming apparatus 1 according to the embodiment is a color printer of a tandem-type which transfers a toner image onto a sheet P using the intermediate transfer belt 31. The image forming apparatus 1 may be what is called a multifunction peripheral provided with the functions of, for example, printing, scanning (image reading), and facsimile transmission.

As shown in FIGS. 1 and 2, the image forming apparatus 1 includes, in its main body 2, a sheet feeding portion 3, a sheet conveying portion 4, an exposure portion 5, an image forming portion 20, a transfer portion 30, a fixing portion 7, a sheet discharge portion 8, and a control portion 9.

The sheet feeding portion 3 stores a plurality of sheets P and, during printing, feeds them out one after another separately. The sheet conveying portion 4 conveys a sheet P fed out from the sheet feeding portion 3 to a secondary transfer portion 33 and then to the fixing portion 7, and then discharges the sheet P after fixing through a sheet discharge port 4*a* to a sheet discharge portion 8. When two-side printing is performed, the sheet conveying portion 4 switches, with a branch portion 4*b*, the conveying direction of the sheet P after fixing on its first side to an inverting conveying portion 4*c*, and conveys the sheet P to the secondary transfer portion 33 and then to the fixing portion 7 once again. The exposure portion 5 shines, toward the image forming portion 20, laser light that is controlled based on image data.

The image forming portion 20 includes an image forming portion for yellow 20Y, an image forming portion for magenta 20M, an image forming portion for cyan 20C, and an image forming portion for black 20B. These four image forming portions 20 have basically similar structures. Thus, in the following description, the letters "Y", "M", "C", and "B" distinguishing different colors may be omitted unless distinction is needed.

The image forming portion 20 includes a photosensitive drum 21 which is an image carrier supported so as to be rotatable in a predetermined direction (the clockwise direction in FIGS. 1 and 2). The image forming portion 20 further includes, arranged around the photosensitive drum 21 along its rotation direction, a charging portion 22, a developing portion 23, and a drum cleaning portion 24. A primary transfer portion 32 is arranged between the developing portion 23 and the drum cleaning portion 24.

The charging portion 22 electrically charges, with, for example, a charging roller, the outer circumferential face of the photosensitive drum 21 to a predetermined potential. Then, the laser light shone from the exposure portion 5 forms an electrostatic latent image of a document image on the outer circumferential face of the photosensitive drum 21. The developing portion 23 develops the electrostatic latent image by feeding toner to it to form a toner image. The four image forming portions 20 form toner images of different colors respectively.

The transfer portion 30 includes an intermediate transfer belt 31, primary transfer portions 32Y, 32M, 32C, and 32B, a secondary transfer portion 33, and a belt cleaning portion 40. The intermediate transfer belt 31 is an endless belt which is supported so as to be rotatable in a predetermined direction (counter-clockwise in FIGS. 1 and 2) and to which the toner images formed on the outer circumferential surfaces of the four image forming portions 20 are sequentially superposed on each other and thereby primarily transferred. The four image forming portions 20 are arranged in what is called a tandem formation in which they are arranged in a row from upstream to downstream in the rotation direction of the intermediate transfer belt 31.

The primary transfer portions 32Y, 32M, 32C, and 32B are arranged over the image forming portions for different colors 20Y, 20M, 20C, and 20B. The secondary transfer portion 33 is arranged upstream of the fixing portion 7 in the sheet conveying direction in the sheet conveying portion 4 and downstream of the image forming portions for different colors 20Y, 20M, 20C, and 20B in the rotation direction of the intermediate transfer belt 31 in the transfer portion 30. The belt cleaning portion 40 is arranged upstream of the image forming portions for different colors 20Y, 20M, 20C, and 20B in the rotation direction of the intermediate transfer belt 31.

A toner image is primarily transferred to the outer circumferential face of the intermediate transfer belt 31 in the primary transfer portions for different colors 32Y, 32M, 32C, and 32B. Then, as the intermediate transfer belt 31 rotates, the toner images in the image forming portions 20 for different colors are sequentially superposed on each other and thereby transferred to the intermediate transfer belt 31 with predetermined timing. In this way, a color toner image with the toner images in four colors, namely yellow, magenta, cyan, and black, superposed together is formed on the outer circumferential face of the intermediate transfer belt 31. The drum cleaning portion 24, after primary transfer, performs cleaning by removing deposits such as toner left on the outer circumferential face of the photosensitive drum 21.

The color toner image on the outer circumferential face of the intermediate transfer belt 31 is transferred to a sheet P conveyed in synchronism by the sheet conveying portion 4 at the secondary transfer nips formed in the secondary transfer portion 33. The belt cleaning portion 40, after secondary transfer, performs cleaning by removing deposits such as toner left on the outer circumferential face of the intermediate transfer belt 31.

The fixing portion 7 heats and presses the sheet P to which the toner image has been transferred to fix the toner image on the sheet P.

The control portion 9 includes an unillustrated CPU, an image processing portion, a storage portion, and other unillustrated electronic circuits and components. The CPU, based on control programs and data stored in the storage portion, controls the operation of different components provided in the image forming apparatus 1 to perform processing related to the functions of the image forming apparatus 1. The sheet feeding portion 3, the sheet conveying portion 4, the exposure portion 5, the image forming portion 20, the transfer portion 30, and the fixing portion 7 individually receive commands from the control portion 9 and coordinate to perform printing on the sheet P. The storage portion is composed of a combination of, for example, an unillustrated non-volatile storage device such as a program ROM (read-only memory) and a data ROM and an unillustrated volatile storage device such as a RAM (random-access memory).

Figure 3:
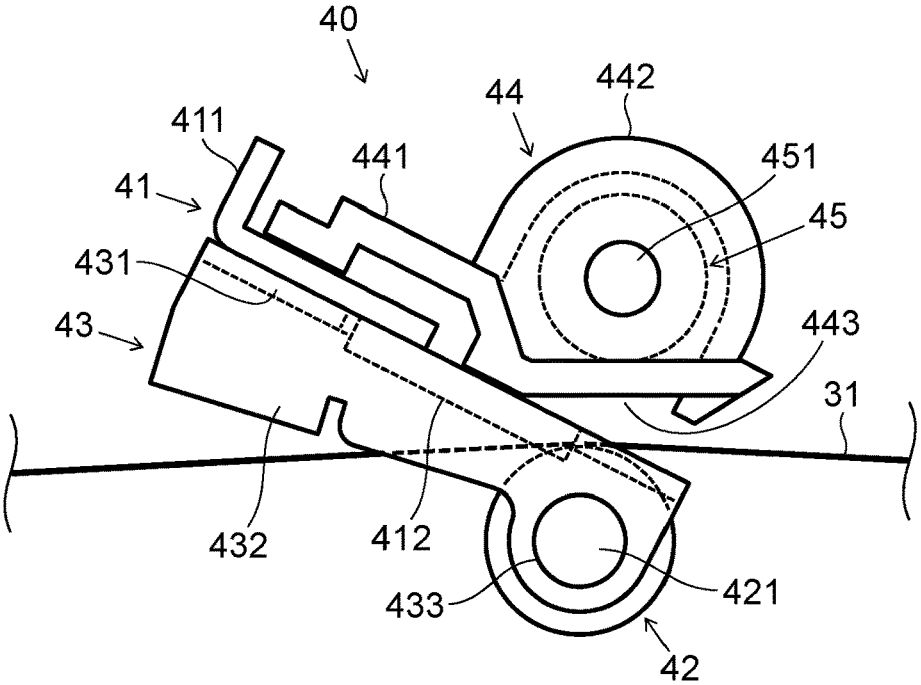
FIG. 3 is a front view of a belt cleaning portion in the image forming apparatus according to the embodiment of the present disclosure.
Figure 4:
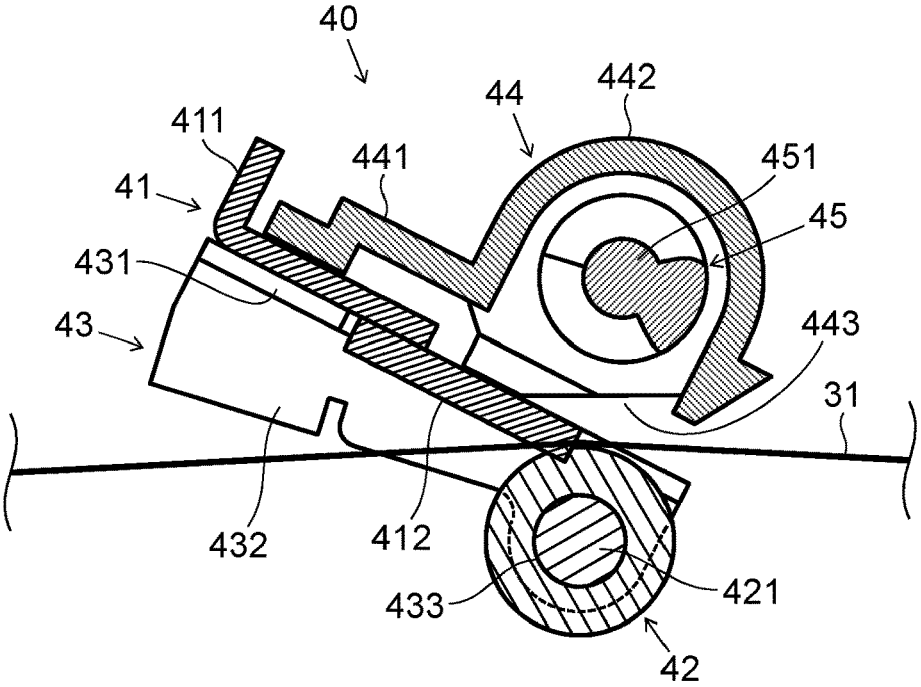
FIG. 4 is a sectional view of the belt cleaning portion in the image forming apparatus according to the embodiment of the present disclosure.

Next, the configuration of and around the belt cleaning portion 40 will be described with reference to FIGS. 2, 3, and 4. FIG. 3 is a front view of the belt cleaning portion 40. FIG. 4 is a sectional view of the belt cleaning portion 40.

As shown in FIG. 2, the intermediate transfer belt 31 is rotatably stretched around a plurality of support rollers. The support rollers in this embodiment include a driving roller 35 and a driven roller 36.

The driving roller 35 is arranged downstream of the image forming portions for different colors 20Y, 20M, 20C, and 20B in the rotation direction of the intermediate transfer belt 31. The driving roller 35 receives a driving force from an unillustrated drive motor to rotate the intermediate transfer belt 31 counter-clockwise in FIG. 2.

The driving roller 35 is arranged adjacent to the secondary transfer portion 33. In the secondary transfer portion 33, a secondary transfer roller 33*r* is arranged. The secondary transfer roller 33*r* is arranged at a position opposite the driving roller 35 across the intermediate transfer belt 31 and is in contact with the outer circumferential face of the intermediate transfer belt 31.

The driven roller 36 is arranged upstream of the image forming portions for different colors 20Y, 20M, 20C, and 20B in the rotation direction of the intermediate transfer belt 31. As the intermediate transfer belt 31 rotates, the driven roller 36 rotates counter-clockwise in FIG. 2. The driven roller 36 is biased by a spring 37 in such a direction as to move away from the driving roller 35. This gives a predetermined tension to the intermediate transfer belt 31.

The intermediate transfer belt 31 is arranged along the four image forming portions 20. Over the four image forming portions 20, primary transfer rollers 32*r* are respectively arranged across the intermediate transfer belt 31. Each primary transfer roller 32*r* is arranged at a position opposite the photosensitive drum 21 across the intermediate transfer belt 31 and is in contact with the inner circumferential face of the intermediate transfer belt 31.

The belt cleaning portion 40 is arranged upstream of the driven roller 36 in the rotation direction of the intermediate transfer belt 31. As shown in FIGS. 3 and 4, the belt cleaning portion 40 includes a cleaning blade 41, a counter-roller 42, a supporting member 43, a housing 44, and a collection screw 45.

The cleaning blade 41 is arranged such that a tip end portion of it makes contact with the outer circumferential face of the intermediate transfer belt 31. The cleaning blade 41 extends in the width direction (in the depth direction with respect to the plane of FIGS. 3 and 4) that intersects with the rotation direction of the intermediate transfer belt 31 and is in contact with the intermediate transfer belt 31 substantially over its entire region in the width direction. The cleaning blade 41 is arranged, with its tip end portion pointing upstream in the rotation direction of the intermediate transfer belt 31, so as to be inclined at a predetermined angle relative to the outer circumferential face of the intermediate transfer belt 31.

The cleaning blade 41 includes a frame portion 411 made of, for example, sheet metal and a blade portion 412 made of, for example, polyurethane rubber. The blade portion 412 is fixed to the frame portion 411 and a tip end portion of it is in contact with the outer circumferential face of the intermediate transfer belt 31. The amount of penetration of the cleaning blade 41 into the intermediate transfer belt 31 is set at, for example, 1.0 mm or larger. The material, the hardness, and the dimension of the cleaning blade 41, the pressing force with which it is pressed against the transfer belt 31, etc. are set as desired to suit the specifications of the intermediate transfer belt 31. The cleaning blade 41 removes deposits such as toner left on the outer circumferential face of the intermediate transfer belt 31.

The counter-roller 42 is arranged at a position opposite the cleaning blade 41 across the intermediate transfer belt 31. The counter-roller 42 is in contact with the inner circumferential face of the intermediate transfer belt 31. The counter-roller 42 extends in the width direction of the intermediate transfer belt 31 and is in contact with the intermediate transfer belt 31 substantially over its entire region in the width direction. As the intermediate transfer belt 31 rotates, the counter-roller 42 rotates in the counter-clockwise in FIGS. 3 and 4.

At least part of the supporting member 43 is arranged outside, in the width direction, both ends of the intermediate transfer belt 31 in its width direction, that is, outside the cleaning blade 41 and the counter-roller 42 in their width direction. The cleaning blade 41 is fixed to the supporting member 43. That is, the supporting member 43 supports the cleaning blade 41.

The supporting member 43 includes a supporting portion 431 and a coupling portion 432. The supporting portion 431 extends in the width direction of the intermediate transfer belt 31, and to the supporting portion 431, the cleaning blade 41 is fixed. The coupling portion 432 extends in the up-down direction which intersects with the width direction of the intermediate transfer belt 31, and has a coupling hole 433. The coupling hole 433 penetrates along the direction of the rotation axis of the counter-roller 42, and through the coupling hole 433, a shaft portion 421 of the counter-roller 42 is inserted. The supporting member 43 is thereby coupled with the counter-roller 42.

The supporting member 43 is rotatable about the rotation axis of the counter-roller 42. That is, the supporting member 43 supports the cleaning blade 41 so as to be rotatable about the rotary shaft of the counter-roller 42.

With the above structure, it is possible to maintain the positional relationship between the cleaning blade 41 and the counter-roller 42. In this way, it is possible to keep constant the amount of penetration of the cleaning blade 41 into the intermediate transfer belt 31 that is held between the cleaning blade 41 and the counter-roller 42. Thus, it is possible to obtain an adequate accuracy of the amount of penetration of the cleaning blade 41, which removes deposits such as toner left on the outer circumferential face of the intermediate transfer belt 31, into the intermediate transfer belt 31. For example, even if the cleaning blade 41 is displaced, the cleaning blade 41 rotates about the rotary shaft of the counter-roller 42, and thus the amount of penetration of the tip end portion into the intermediate transfer belt 31 does not change.

The housing 44 is arranged over the cleaning blade 41 so as to cover the cleaning blade 41. The housing 44 has a coupling portion 441, an accommodating portion 442, and an opening portion 443. The coupling portion 441 is arranged over the frame portion 411 of the cleaning blade 41. The housing 44 is fixed to the frame portion 411 of the cleaning blade 41. The accommodating portion 442 is arranged over the blade portion 412 of the cleaning blade 41. The accommodating portion 442 is structured substantially in a cylindrical shape that extends in the width direction of the intermediate transfer belt 31. The accommodating portion 442 accommodates inside it the collection screw 45. The opening portion 443 is arranged at a position under the accommodating portion 442, over a tip end portion of the cleaning blade 41, opposite the intermediate transfer belt 31. The housing 44 accommodates the deposits on the intermediate transfer belt 31 removed by the cleaning blade 41.

As described above, the housing 44 is configured such that it is not fixed to the frame of an unillustrated unit that supports the intermediate transfer belt 31 or the frame of the main body 2, but is fixed to the cleaning blade 41. This makes it possible to maintain the positional relationship between the cleaning blade 41 and the counter-roller 42. Thus, it is possible to keep the amount of penetration of the cleaning blade 41 into the intermediate transfer belt 31 constant.

The collection screw 45 is arranged inside the accommodating portion 442 of the housing 44. The collection screw 45 is configured to have, on the outer circumferential face of a shaft portion extending in the width direction of the intermediate transfer belt 31, a conveying blade that extends in a helical shape along the axial direction. The collection screw 45 is supported on the accommodating portion 442 of the housing 44 so as to be rotatable about the axial line extending in the width direction of the intermediate transfer belt 31.

The collection screw 45 conveys the deposits on the intermediate transfer belt 31, now stored inside the housing 44, in the width direction of the intermediate transfer belt 31. Then, the collection screw 45 discharges the deposits on the intermediate transfer belt 31 out of the housing 44 to collect them. The deposits on the intermediate transfer belt 31, now collected by the collection screw 45, are conveyed to an unillustrated collection container, where they are stored.

Figure 5:
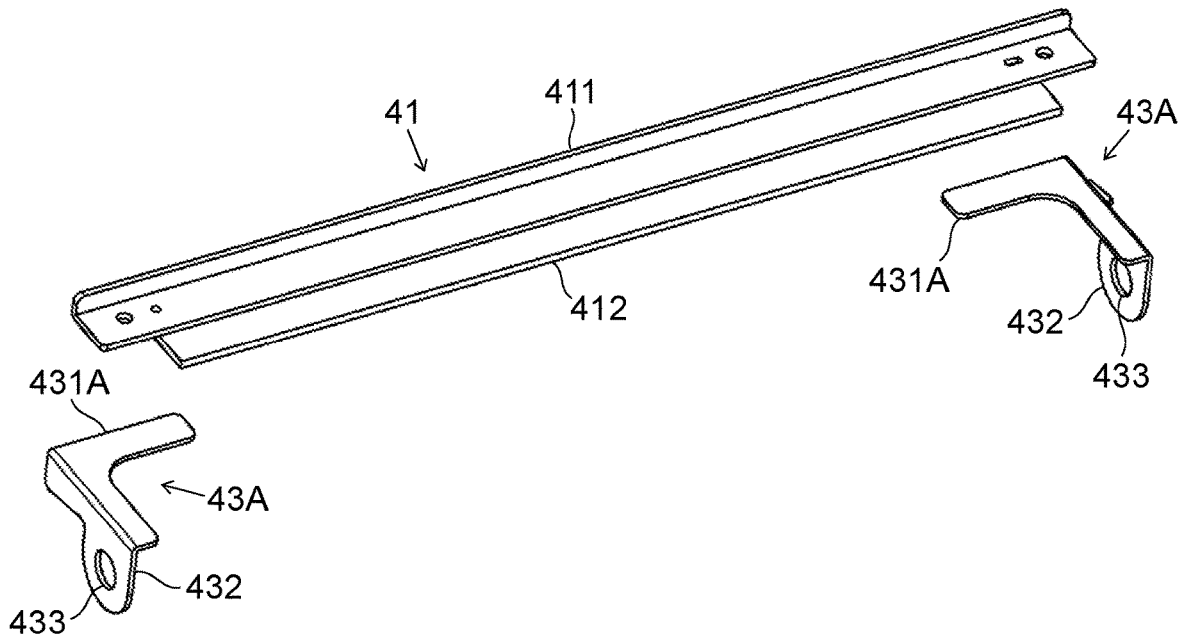
FIG. 5 is a perspective view showing Structure Example 1 of the cleaning blade and a supporting member in the belt cleaning portion in the image forming apparatus according to the embodiment of the present disclosure.

Next, an example of the structure of the cleaning blade 41 and the supporting member 43 will be described. FIG. 5 is a perspective view showing Structure Example 1 of the cleaning blade 41 and the supporting member 43.

As shown in FIG. 5, a supporting member 43A in Structure Example 1 is composed of two members, which are individually arranged at both edges of the intermediate transfer belt 31 in its width direction. The two supporting members 43A each have a supporting portion 431A that extends inwards in the width direction of the intermediate transfer belt 31. Each supporting portion 431A has a top face that faces the bottom face of the frame portion 411 of the cleaning blade 41. To the supporting portion 431A, the frame portion 411 of the cleaning blade 41 is fixed by a fastening member such as a screw. The blade portion 412 of the cleaning blade 41 is disposed upstream of the supporting portion 431A in the rotation direction of the intermediate transfer belt 31.

Figure 6:
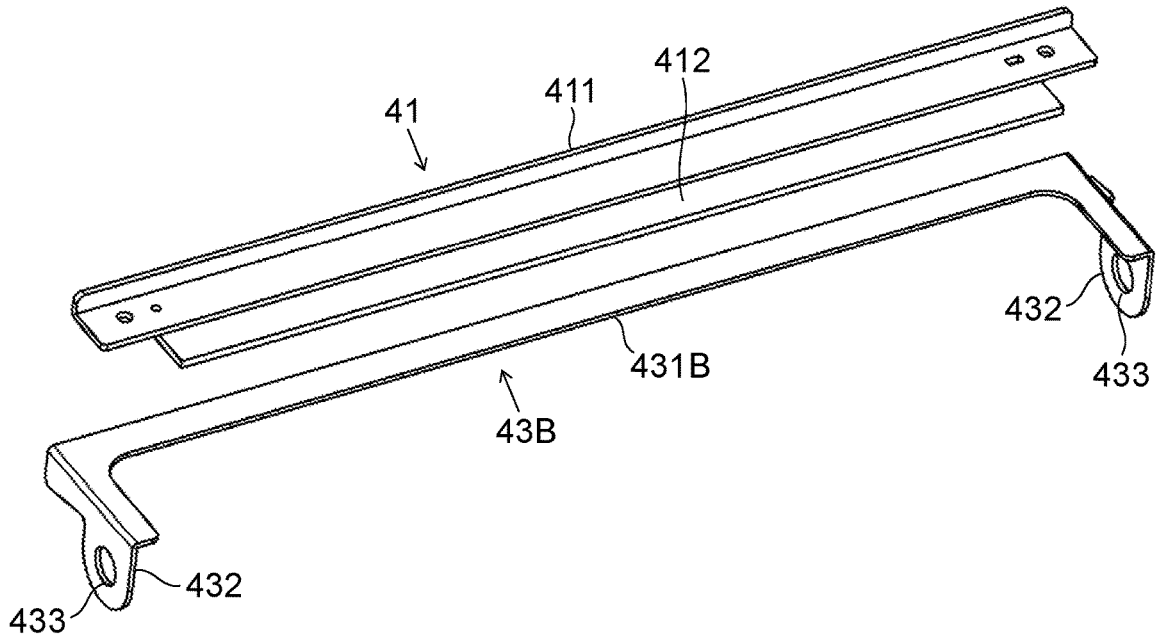
FIG. 6 is a perspective view showing Structure Example 2 of the cleaning blade and the supporting member in the belt cleaning portion in the image forming apparatus according to the embodiment of the present disclosure.

FIG. 6 is a perspective view showing Structure Example 2 of the cleaning blade 41 and the supporting member 43.

As shown in FIG. 6, a supporting member 43B in Structure Example 2 is configured as a single member, and is arranged from one edge to the other of the intermediate transfer belt 31 in its width direction. A supporting portion 431B of the supporting member 43B extends from one edge to the other of the intermediate transfer belt 31 in its width direction. The supporting portion 431B has a top face that faces the bottom face of the frame portion 411 of the cleaning blade 41. To the supporting portion 431B, the frame portion 411 of the cleaning blade 41 is fixed by a fastening member such as a screw. The blade portion 412 of the cleaning blade 41 is disposed upstream of the supporting portion 431B in the rotation direction of the intermediate transfer belt 31.

Figure 7:
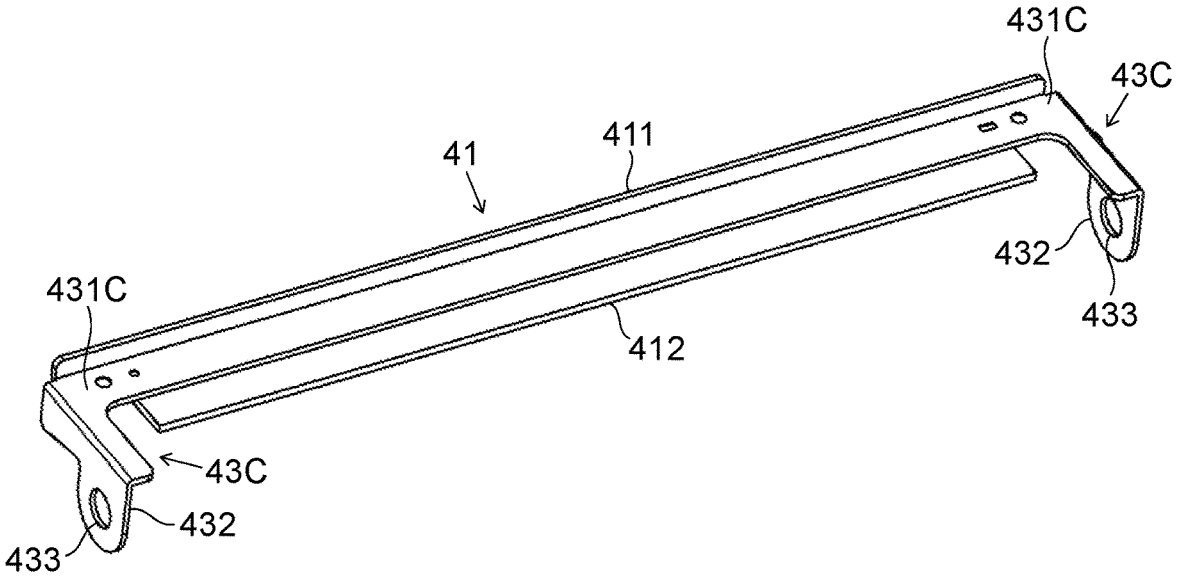
FIG. 7 is a perspective view showing Structure Example 3 of the cleaning blade and the supporting member in the belt cleaning portion in the image forming apparatus according to the embodiment of the present disclosure.

FIG. 7 is a perspective view showing Structure Example 3 of the cleaning blade 41 and the supporting member 43.

As shown in FIG. 7, the supporting member 43C in Structure Example 3 is integral with the cleaning blade 41. That is, the cleaning blade 41 and the supporting member 43C are configured as a single member. Specifically, a region that results from extending the frame portion 411 of the cleaning blade 41 toward both edges of the intermediate transfer belt 31 in its width direction is a supporting portion 431C of the supporting member 43C. In other words, a region resulting from extending the supporting portions 431C of the supporting member 43C disposed individually at both edges of the intermediate transfer belt 31 in its width direction inwards in the width direction of the intermediate transfer belt 31 is the frame portion 411 of the cleaning blade 41.

In this configuration, the cleaning blade 41 and the supporting member 43C are not connected by a fastening member such as a screw or the like, and this helps prevent accumulation of dimension errors in different components. This makes it possible to maintain a proper positional relationship between the cleaning blade 41 and the counter-roller 42.

Figure 8:
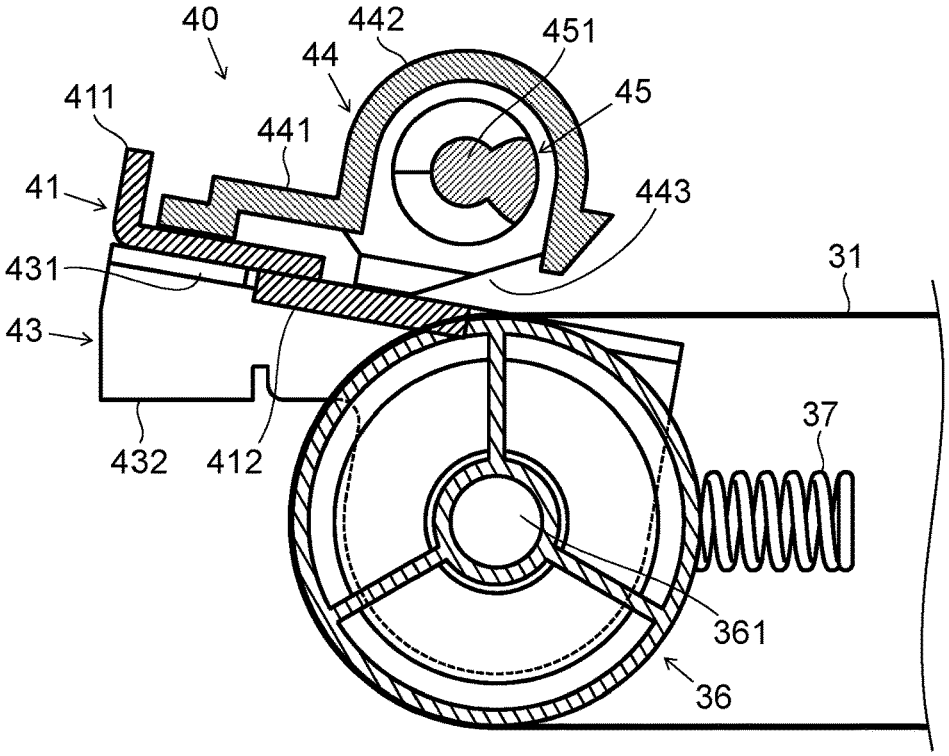
FIG. 8 is a sectional view of the belt cleaning portion in the image forming apparatus according to Modified Example 1 of the embodiment of the present disclosure.
Figure 9:
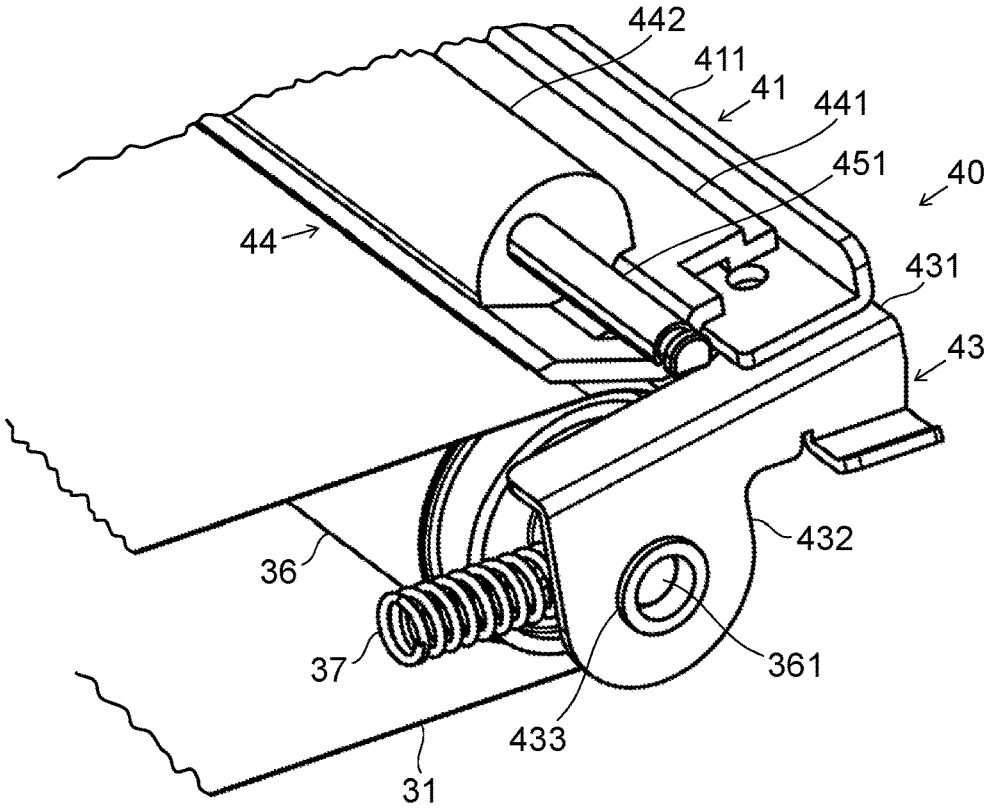
FIG. 9 is a perspective view of the belt cleaning portion in the image forming apparatus according to Modified Example 1 of the embodiment of the present disclosure as seen from above.
Figure 10:
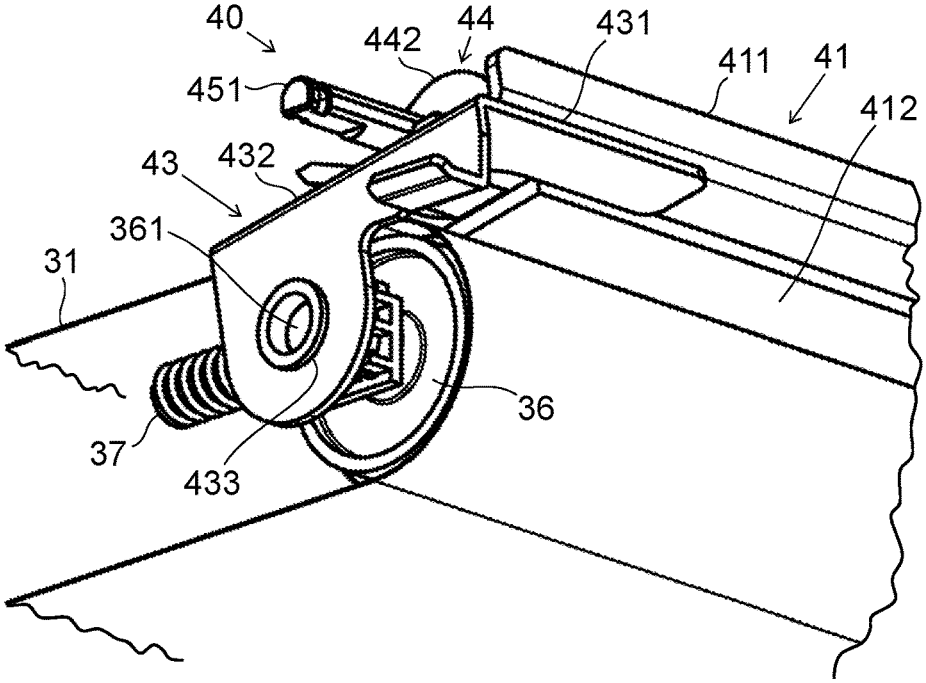
FIG. 10 is a perspective view of the belt cleaning portion in the image forming apparatus according to Modified Example 1 of the embodiment of the present disclosure as seen from below.

Next, an image forming apparatus 1 according to Modified Example 1 of the embodiment will be described. FIG. 8 is a sectional view of the belt cleaning portion 40 in the image forming apparatus 1 of Modified Example 1. FIG. 9 is a perspective view of the belt cleaning portion 40 in the image forming apparatus 1 of Modified Example 1 as seen from above. FIG. 10 is a perspective view of the belt cleaning portion 40 in the image forming apparatus 1 of Modified Example 1 as seen from below. The configuration of Modified Example 1 is basically the same as that of the embodiment described previously. Accordingly such elements as find their counterparts in the embodiment described previously are assigned the same reference signs as used previously and their description may be omitted.

As shown in FIGS. 8, 9, and 10, in the image forming apparatus 1 of Modified Example 1, the counter-roller in the belt cleaning portion 40 is the driven roller 36, which is one of the support rollers around which the intermediate transfer belt 31 is stretched.

The coupling portion 432 of the supporting member 43 extends in the up-down direction which intersects with the width direction of the intermediate transfer belt 31, and has a coupling hole 433. The coupling hole 433 penetrates along the direction of the rotation axis of the driven roller 36, and through the coupling hole 433, a shaft portion 361 of the driven roller 36 is inserted. The supporting member 43 is thereby coupled with the driven roller 36.

The supporting member 43 is rotatable about the rotation axis of the driven roller 36. That is, the supporting member 43 supports the cleaning blade 41 so as to be rotatable about the rotation axis of the driven roller 36, which is the counter-roller opposite the cleaning blade 41.

With the structure of Modified Example 1 described above, it is possible to maintain the positional relationship between the cleaning blade 41 and the driven roller 36. This makes it possible to keep constant the amount of penetration of the cleaning blade 41 into the intermediate transfer belt 31 that is held between the cleaning blade 41 and the driven roller 36. Thus, it is possible to obtain an adequate accuracy of the amount of penetration of the cleaning blade 41, which removes deposits such as toner left on the outer circumferential face of the intermediate transfer belt 31, into the intermediate transfer belt 31. For example, even if the cleaning blade 41 is displaced, the cleaning blade 41 rotates about the rotation axis of the driven roller 36, and thus the amount of penetration of the tip end portion into the intermediate transfer belt 31 does not change.

Also, no counter-roller is required, and this helps reduce the number of components and the number of assembly steps. Nor is there need to secure a space for installing a counter-roller.

Figure 11:
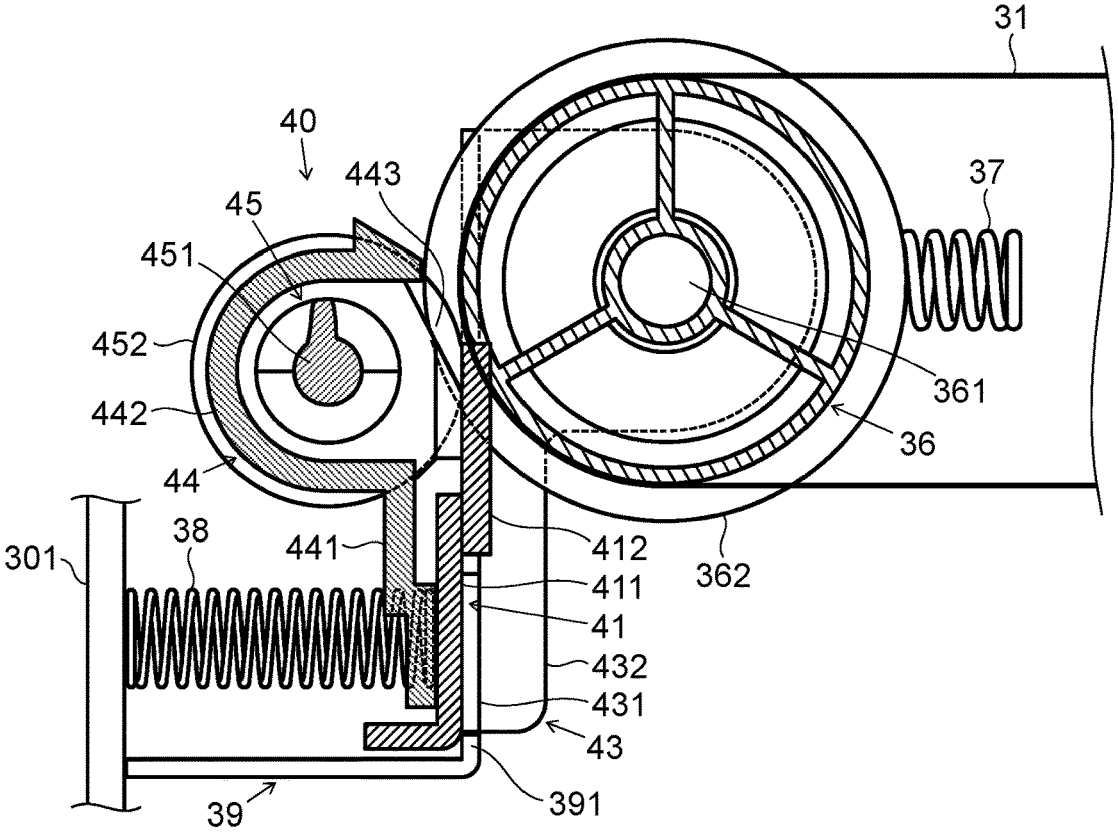
FIG. 11 is a sectional view of the belt cleaning portion in the image forming apparatus according to Modified Example 2 of the embodiment of the present disclosure.
Figure 12:
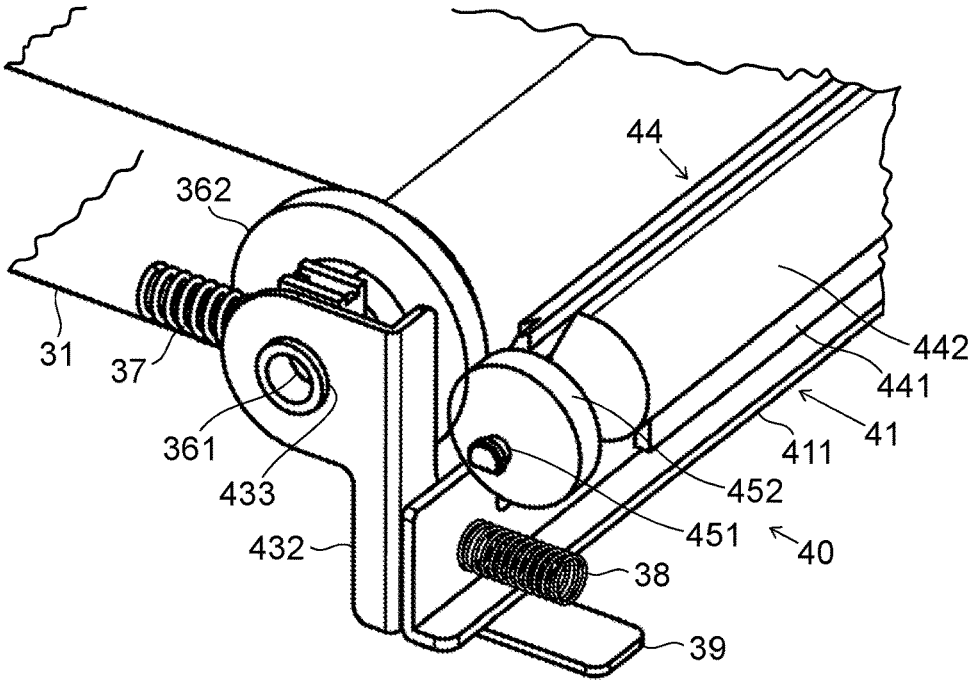
FIG. 12 is a perspective view of the belt cleaning portion in the image forming apparatus according to Modified Example 2 of the embodiment of the present disclosure.

Next, the image forming apparatus 1 according to Modified Example 2 of the embodiment will be described. FIG. 11 is a sectional view of the belt cleaning portion 40 in the image forming apparatus 1 of Modified Example 2. FIG. 12 is a perspective view of the belt cleaning portion 40 in the image forming apparatus 1 of Modified Example 2. The configuration of Modified Example 2 is basically the same as those of the embodiment and Modified Example 1 described previously. Accordingly, such elements as find their counterparts in the embodiment described previously are assigned the same reference signs as used previously and their description may be omitted.

As shown in FIGS. 11 and 12, in the image forming apparatus 1 of Modified Example 2, the counter-roller in the belt cleaning portion 40 is the driven roller 36, which is one of the support rollers around which the intermediate transfer belt 31 is stretched.

The transfer portion 30 includes a first gear 362. The first gear 362 is fixed to an end part of the shaft portion 361 of the driven roller 36 in its axial direction. The first gear 362 rotates about the rotation axis of the driven roller 36 as the driven roller 36, which is the counter-roller of the cleaning blade 41, rotates.

The belt cleaning portion 40 includes a second gear 452. The second gear 452 is fixed to an end part of a shaft portion 451 of the collection screw 45 in its axial direction. The second gear 452 meshes with the first gear 362. The second gear 452 is rotated by the first gear 362 about the rotation axis of the collection screw 45 and rotates the collection screw 45.

With the structure of Modified Example 2 described above, it is possible to rotate the collection screw 45 by obtaining a driving force from the driven roller 36 that rotates by following the intermediate transfer belt 31, which is rotated by the driving roller 35. With this, it is possible to obtain a rotation driving force for the collection screw 45 easily, and there is no need to prepare a driving source separately. Any other idle gears or the like may be provided between the first gear 362 and the second gear 452.

The transfer portion 30 further includes a spring 38 and a rotation restricting portion 39. The spring 38 and the rotation restricting portion 39 are provided, for example, on the frame portion 301 of the transfer portion 30.

The spring 38 is configured as, for example, a compressed coil spring and is arranged between the frame portion 301 of the transfer portion 30 and the cleaning blade 41 of the belt cleaning portion 40. The spring 38, at one end in the expansion-contraction direction, makes contact with the frame portion 301 and, at the other end, makes contact with the cleaning blade 41. The spring 38 biases the cleaning blade 41 such that the cleaning blade 41 rotates along the rotation direction (counter-clockwise in FIG. 11) of the driven roller 36 about the rotation axis of the driven roller 36.

The rotation restricting portion 39 is arranged downstream of the belt cleaning portion 40 in the rotation direction of the driven roller 36. The rotation restricting portion 39 is, for example, a plate-like member. The rotation restricting portion 39, at a tip end portion 391 of it, makes contact with the cleaning blade 41 and the supporting member 43. The rotation restricting portion 39 only needs to make contact with at least one of the cleaning blade 41 and the supporting member 43. The rotation restricting portion 39 restricts the rotation angle of the cleaning blade 41 about the rotation axis of the driven roller 36 within a predetermined range of angles. That is, the cleaning blade 41 does not rotate in the counter-clockwise, which is the rotation direction of the driven roller 36, beyond the angle shown in FIG. 11.

According to the above structure, the cleaning blade 41 can be positioned with respect to the rotation direction of the driven roller 36 (counter-roller). This makes it possible to maintain a proper positional relationship between the cleaning blade 41 and the driven roller 36. Thus, it is possible to keep constant the amount of penetration of the cleaning blade 41 into the intermediate transfer belt 31. The rotation restricting portion may be provided, for example, on the frame or the like of the main body 2 and may be in the shape of, for example, a block or the like.

The description given above of an embodiment of the present disclosure is in no way meant to limit the scope of the present disclosure; the present disclosure can be implemented with any modifications made without departing from the spirit of the present disclosure.

For example, in the embodiment described above, the image forming apparatus 1 is a color-printing image forming apparatus of what is called a tandem type, but this is not meant as any limitation to that and similar types. The image forming apparatus may be a color-printing image forming apparatus of any type other than a tandem type so long as it has an intermediate transfer belt.

What is claimed is:

1. An image forming apparatus comprising:

a plurality of image carriers;

an endless intermediate transfer belt, to which toner images formed on outer circumferential faces of the plurality of image carriers are transferred by being sequentially superposed on each other;

a cleaning blade which is arranged such that a tip end portion thereof makes contact with an outer circumferential face of the intermediate transfer belt and which removes deposits left on the outer circumferential face of the intermediate transfer belt;

a counter-roller which is arranged at a position opposite the cleaning blade across the intermediate transfer belt and which makes contact with an inner circumferential face of the intermediate transfer belt; and a supporting member which supports the cleaning blade, wherein the supporting member supports the cleaning blade rotatably about a rotation axis of the counter-roller, and the cleaning blade and the supporting member are configured as a single member.

2. The image forming apparatus according to claim 1, further comprising a plurality of support rollers around which the intermediate transfer belt is rotatably stretched, wherein the counter-roller is one of the support rollers.

3. The image forming apparatus according to claim 1, further comprising a housing which accommodates the deposits on the intermediate transfer belt removed by the cleaning blade, wherein the housing is fixed to the cleaning blade.

4. The image forming apparatus according to claim 3, further comprising:

a first gear which rotates about the rotation axis of the counter-roller as the counter-roller rotates;

a collection screw which is arranged inside the housing and which discharges the deposits on the intermediate transfer belt out of the housing to collect the deposits; and a second gear which is rotated by the first gear about a rotation axis of the collection screw and which rotates the collection screw.

5. The image forming apparatus according to claim 1, further comprising a rotation restricting portion which makes contact with at least one of the cleaning blade and the supporting member, and which restricts a rotation angle of the cleaning blade about the rotation axis of the counter-roller within a predetermined range of angles.

* * * * *